United States Patent [19]

Anderson

[11] 4,067,167

[45] Jan. 10, 1978

[54] TOP ASSEMBLY

[75] Inventor: Clarence A. F. Anderson, Fruitport, Mich.

[73] Assignee: The Shaw-Walker Company, Muskegon, Mich.

[21] Appl. No.: 674,984

[22] Filed: Apr. 8, 1976

[51] Int. Cl.[2] ..... A47B 13/08

[52] U.S. Cl. ..... 52/614

[58] Field of Search ..... 52/614, 287, 288; 312/140.1, 140.3

[56] References Cited

U.S. PATENT DOCUMENTS

| | | | |
|---|---|---|---|
| 1,542,138 | 6/1925 | Hunter | 52/623 |
| 2,192,145 | 2/1940 | Munger | 52/614 |
| 2,267,444 | 12/1941 | Corduan | 52/614 |
| 2,635,935 | 4/1953 | Anderson | 52/614 |
| 2,981,579 | 4/1961 | Shwayder | 52/623 |

*Primary Examiner*—John E. Murtagh

*Attorney, Agent, or Firm*—Kinzer, Plyer, Dorn & McEachran

[57] ABSTRACT

A top assembly for desks, tables, credenzas and similar items having a metal core and an outer covering of a thin hard laminated plastic. The thin hard laminated plastic covers the top surface of the metal core and is wrapped around the side and end walls and the undersurface edges thereof. The side and end walls of the metal core extend generally at right angles to the top surface thereof providing the top assembly with a squared planar appearance. The thin laminated plastic covering is unbroken by seams or metal rims along the side and end edges of the top assembly. The only portions of the laminated plastic covering that are slit or cut are at the corners of the top assembly and these portions are covered by metal caps.

4 Claims, 12 Drawing Figures fig.6.
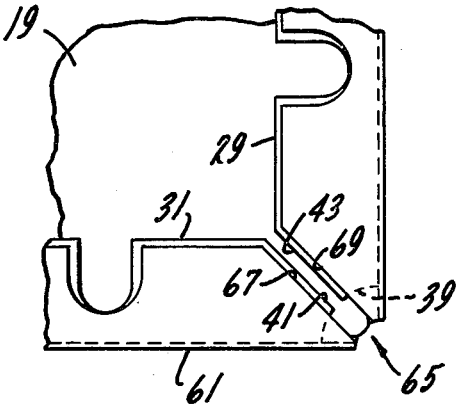
fig.7.
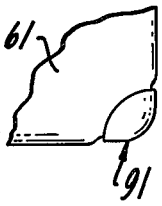
fig.8.
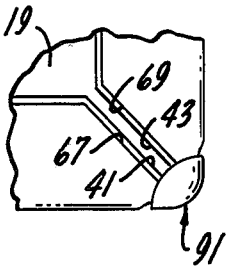
fig.9.
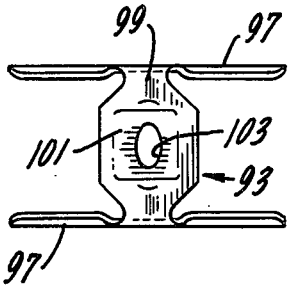
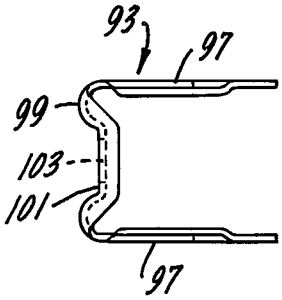
fig.10.
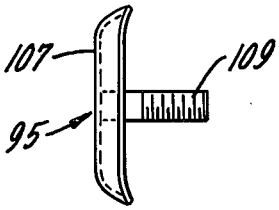
fig.11.
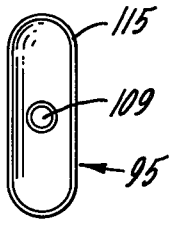
fig.12.

TOP ASSEMBLY

SUMMARY OF THE INVENTION

This invention is concerned with a top assembly for desks, tables, credenzas, and similar items having a continuous thin laminated plastic covering which is wrapped around the side and end walls thereof.

An object of this invention is a tough laminated plastic covering for a top assembly of a desk, table, credenza or similar item which covering extends over the side and end walls and undersurface edges of the top assembly without interruption or break by seam or rim.

Another object is a top assembly for desks, tables, credenzas, and similar items having squared sides and ends with a laminated plastic covering wrapped around the sides and ends without seam or rim.

Another object is a thin hard laminated plastic covered top assembly having end and side top edges which are slightly rounded.

Another object is a top assembly having a metal core and a wrap-around tough laminated plastic covering.

Another object is a top assembly having a metal core and a tough thin laminated plastic covering without sharp edges or corners.

Other objects may be found in the following specification, claims and drawings.

BRIEF DESCRIPTION OF THE DRAWINGS

The invention is illustrated more or less diagrammatically in the following drawings wherein:

FIG. 6 is a partial bottom plan view of the top assembly at one stage of construction with parts omitted for clarity of illustration;

FIG. 7 is a top plan view of a corner of the top assembly;

FIG. 8 is a bottom plan view of a corner of the top assembly;

FIG. 9 is a front elevational view of a corner bracket;

FIG. 10 is a side elevational view of a corner bracket;

FIG. 11 is a side elevational view of a corner cap; and

FIG. 12 is a rear elevational view of a corner cap.

DESCRIPTION OF THE PREFERRED EMBODIMENT

Figure 1:
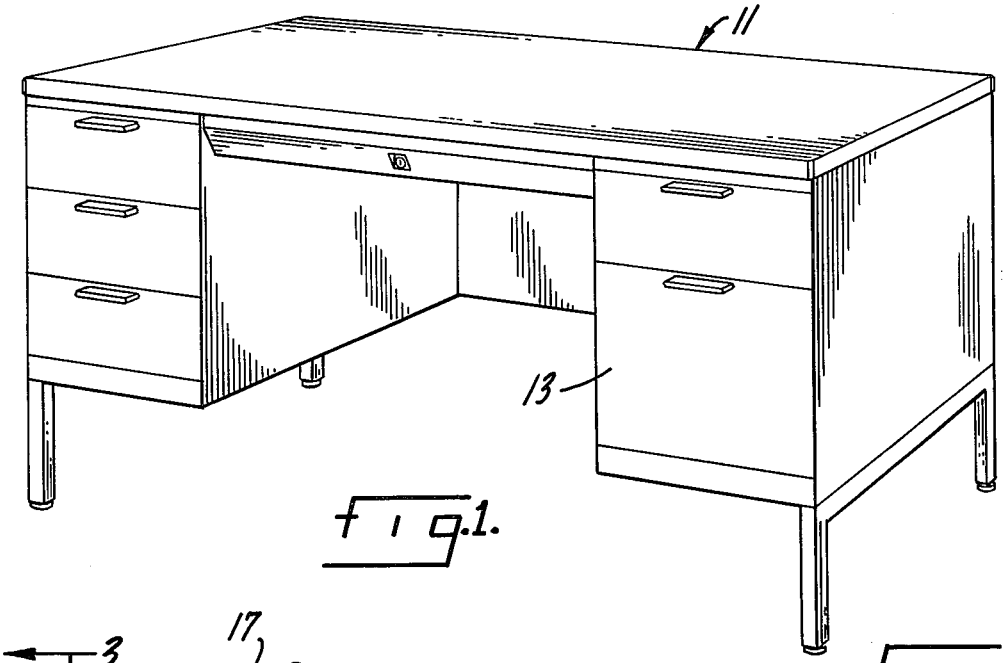
FIG. 1 is a perspective view of the top assembly of this invention mounted on a desk.

FIG. 1 of the drawings shows a top assembly 11, constructed in accordance with the teachings of this invention, mounted on a desk 13 of the double pedestal type. The top assembly of this invention may also be installed on tables, credenzas, cabinets and similar items.

The top assembly 11 of the preferred embodiment of the invention includes a generally rectangular inverted pan-shaped sheet metal housing 15 which is attached to and reinforced by a framework of longitudinally extending metal channel members 17. The channels are welded or otherwise fastened to the sheet metal pan 15.

The sheet metal housing 15 includes a generally rectangular top planar wall 19 and integral turned down end and side walls 21 and 23. The end and side walls extend generally at right angles to the top wall and are connected to the top wall by curved portions of small radius such as curved portion 25, shown in FIG. 3, which connects top wall 19 and side wall 23. A similar curved portion of small radius connects top wall 19 and end wall 21 but it is not shown in the drawings for clarity of illustration. The end walls 21 and side walls 23 have inwardly projecting portions 29 and 31 respectively at the lower edges thereof. These inwardly projecting portions are connected to the end and side walls by curved portions 33 and 35 of small radius. The inwardly projecting portions 29 and 31 extend at right angles to the end and side walls and are parallel to the top wall 19. This construction provides a top assembly which has a "squared" or "planar" appearance.

Figure 5:
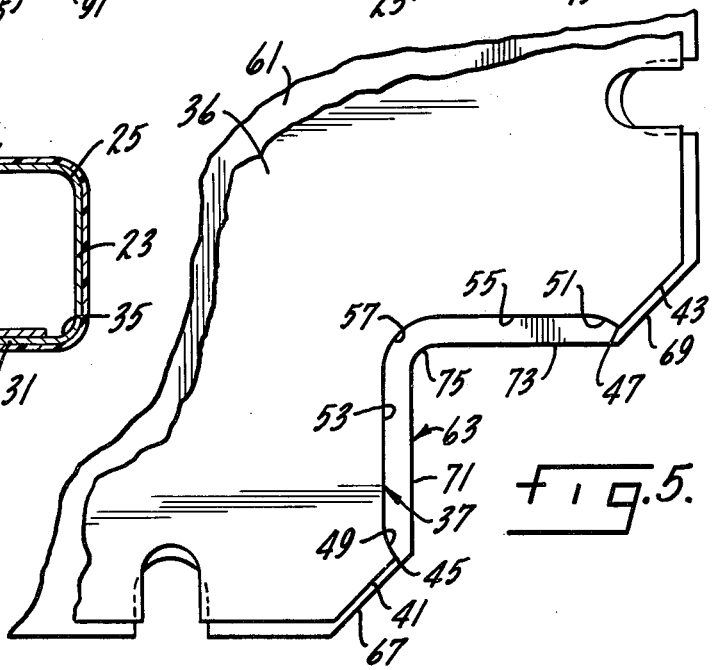
FIG. 5 is a partial plan view of blanks for the top core and laminated covering superimposed one upon the other.

The sheet metal pan 15 is formed from a rectangular sheet 36 of metal using conventional metal bending and shearing equipment. FIG. 5 of the drawings shows the metal sheet 36 before bending but after corner notches 37 have been die-cut in the sheet. The notches provide gaps 39 or cutaway portions at the corners of the sheet metal pan after bending. Each corner notch 37 is somewhat rectangular in shape with aligned edges 41 and 43 which extend at a 45° angle to the side and end edges of the unbent metal sheet 36. The edges terminate in sharp peaks 45 and 47, respectively. Curved portions 49 and 51 lead inwardly from the peaks to straight edges 53 and 55 which extend at right angles to each other. The straight edges meet in an arcuate portion 57 having the same radius as the curved portions 49 and 51.

Figure 4:
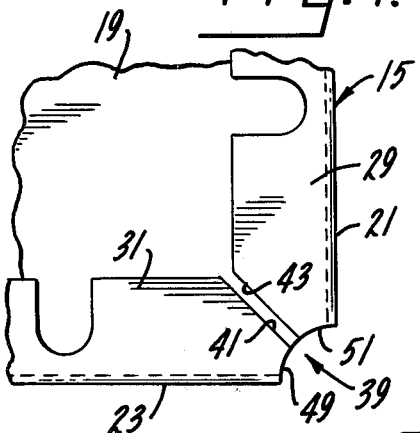
FIG. 4 is a partial bottom plan view of a corner of the metal core of the top assembly.

When the metal sheet 36 is bent to form end and side walls 21 and 23, as shown in FIG. 4, the arcuate portion 57 of each corner notch becomes the top of the gap 39 located at each corner of the sheet metal pan or housing 15. The straight edges 53 and 55 become the vertical side edges of the gap. The curved portions 49 and 51 form the concave portion at the bottom of the gap and the edges 41 and 43 extend parallel to each other on the undersurface or inwardly projecting portions 29 and 31 of the sheet metal housing. The edges 41 and 43 are spaced a small distance from each other and extend at an angle of 45° relative to the side and end walls of the sheet metal housing.

A laminated plastic sheet 61 of slightly greater dimensions than the metal sheet 36 is adhered to the sheet metal housing 15. The laminated plastic sheet is shown underlying the metal sheet 36 in FIG. 5 of the drawings. The laminated plastic sheet is formed of a low pressure polyester resin laminate. This laminate is thinner than the laminates commonly used in furniture in that its thickness is approximately 0.030 inches. A suitable laminated plastic is sold by Conolite Division/Woodall Industries, Inc. of Carpentersville, Illinois under the trademark "CONOLITE". The corners of the laminated plastic sheet 61 are die-cut to provide notches 63. The notches 63 of the laminated plastic sheet are slightly smaller than the notches 37 formed in the metal sheet 36. This permits the laminated plastic sheet to overlap the gaps 39 formed in the corners of the sheet metal pan when the laminated plastic sheet is folded over and adhered to the sheet metal pan. The laminated plastic is adhered to the metal pan 15 by means of a contact cement through the application of pressure and heat to the laminated plastic sheet.

Figure 2:
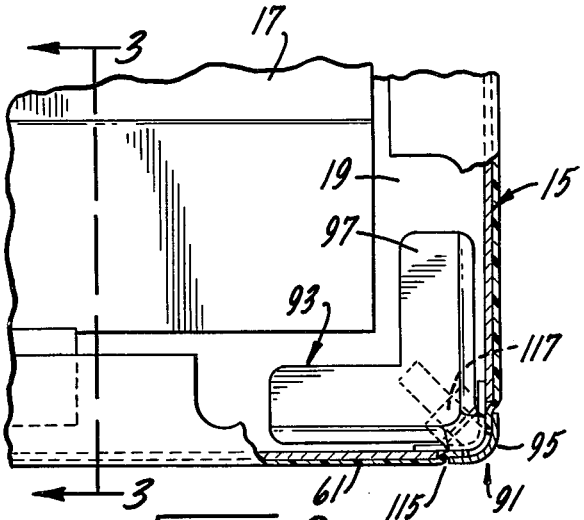
FIG. 2 is a partial bottom plan view of a corner of the top assembly with portions broken away for clarity of illustration.
Figure 3:
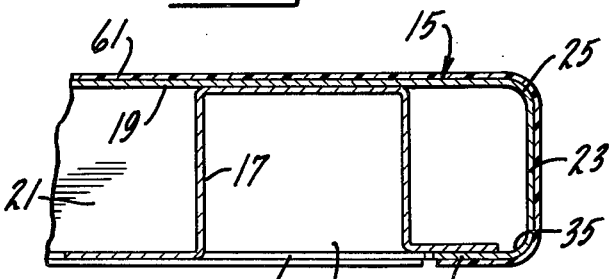
FIG. 3 is a cross-sectional view taken along lines 3—3 of FIG. 2.

As shown in FIG. 5, the notched corners 63 of the laminated plastic sheet 61 have aligned edges 67 and 69 which extend at an angle of 45° to the side and end edges of the laminated plastic sheet. The aligned edges 67 and 69 merge with edges 71 and 73 extending at right angles to each other. The edges 71 and 73 meet in a curved portion 75. When the laminated plastic sheet is bent around and adhered to the sheet metal housing 15, as shown in FIGs. 2, 3 and 6, the gap 65 formed in the laminated plastic will be narrower than the gap 39 formed in the sheet metal so that the laminated plastic overlaps the edges of the sheet metal housing at the corner gaps. The aligned edges 67 and 69 of the laminated plastic covering will be located against the undersurfaces or inwardly projecting portions 29 and 31 of the sheet metal housing. These edges will be spaced apart slightly more than the edges 41 and 43 of the sheet metal housing to insure that the thin laminated plastic sheet is backed by metal to strengthen the plastic covering and to resist separation of the laminated plastic sheet from the metal housing.

A corner assembly 91 is provided for each corner of the top assembly and is shown installed in FIG. 2. The purpose of the corner assembly is to close the gap 39 in the sheet metal housing, to cover the exposed edges of the laminated plastic covering and to provide a corner which is snag free. The assembly includes a reinforcing or backing member 93 which fits inside a corner of the sheet metal housing 15 and a stainless steel corner cap 95 which fits on the outside of the laminated plastic covering. The reinforcing member 93, shown in detail in FIGS. 2, 9 and 10 of the drawings, includes L-shaped top and bottom portions 97 which are integrally joined at their peaks to a connecting portion 99 which extend at right angles to the top and bottom portions. The connecting portion lies in a plane at an angle of approximately 45° to the edges of the L-shaped top and bottom portions as shown most clearly in FIG. 2. The connecting portion is somewhat hexagonal in shape and is embossed to provide a rectangular offset base 101 having an opening 103 formed therein. A reinforcing member 93 is welded into each corner of the sheet metal housing 15 with one L-shaped portion of each reinforcing member welded to the top wall 19 of the housing and the other L-shaped portion of the reinforcing member welded to the inner surface of the inwardly projecting portions 29 and 31 of the end and side walls.

The corner cap 95, shown in detail in FIGS. 11 and 12 of the drawings, has an elongated, somewhat oval shaped head 107 having a convex outer surface and a concave inner surface. A threaded rod 109 is welded to and extends from the concave inner surface of the head. The inner peripheral edge 115 of the head is flattened for better contact with and to reduce damage to the laminated plastic sheet. When installed on the corners of the top assembly, the inner peripheral edge 115 of the corner cap engages the edges of the laminated plastic sheet 61 which extends over the edges of the gap 39 in the sheet metal housing 15. The threaded rod 109 extends through the opening 103 in the base 101 of the reinforcing member 93. A nut 117 threads onto the rod 109 and is tightened securely against the base 101 of the reinforcing member to securely hold the corner cap in position. Preferably, the nut is tightened sufficiently so that the inner peripheral edge 115 of the corner cap forces the edges of the laminated plastic sheet 61 into the gap 39 formed in the sheet metal housing so that the outer surface of the head 107 of the cap is either recessed or is at least flush with the outer surface of the laminated plastic covering.

I claim:

1. A top assembly for desks, tables, credenzas and similar items, said top assembly including:

a sheet metal member having a planar top surface of generally rectangular shape, depending side and end walls extending generally at right angles to said planar top surface and inwardly projecting portions at the lower edges of said side and end walls with said inwardly projecting portions extending generally parallel to said planar top surface, a one piece sheet of laminated plastic adhered to said top surface, said side and end walls and said inwardly projecting portions to closely follow the contours thereof and to provide a laminated plastic surface for said top assembly which is continuous and uninterrupted along the side and end edges of the top assembly, gaps formed in said sheet metal member between the side and end walls at the corners thereof;

said laminated plastic sheet having similar but narrower gaps at the corners thereof so that the laminated plastic sheet overlaps the gaps in the corners of the sheet metal member, and metal caps positioned at the corners of the top assembly with the metal caps covering the gaps in the laminated plastic sheet but not in the sheet metal member so that the caps force the laminated plastic sheet into the gaps formed in the corners of the sheet metal member to position the outer surfaces of the metal caps flush with the outer surfaces of the laminated plastic sheet.

2. The top assembly of claim 1 in which said metal caps are fastened to said top assembly by rods fastened to the caps and connected to backing members which are located inside the corners of the sheet metal housing.

3. The top assembly of claim 2 in which said backing members each includes L-shaped top and bottom portions which are integrally joined at their peaks to a connecting portion extending at right angles to the top and bottom portions, said connecting portion having an opening therein to receive the rod of said metal cap.

4. The top assembly of claim 1 in which said metal caps each have an elongated, oval shaped head, said head has a convex outer surface and a concave inner surface, a rod extends from the concave inner surface of the head and is fastened to the sheet metal member, and the peripheral edge of the inner surface of the head is flattened for contact with the laminated plastic sheet.

* * * * *